United States Patent [19]

Yanagi

[11] 4,305,363

[45] Dec. 15, 1981

[54] CENTRIFUGAL GOVERNOR

[75] Inventor: Hideichi Yanagi, Higashi-Matsuyama, Japan

[73] Assignee: Diesel Kiki Co., Ltd., Higashi-Matsuyama, Japan

[21] Appl. No.: 73,937

[22] Filed: Sep. 10, 1979

[30] Foreign Application Priority Data

Oct. 11, 1978 [JP] Japan ..... 53-139259

[51] Int. Cl.[3] ..... F02D 31/00

[52] U.S. Cl. ..... 123/373; 123/372; 123/364

[58] Field of Search ..... 123/365, 364, 372, 373, 123/374

[56] References Cited

U.S. PATENT DOCUMENTS

| | | | |
|---|---|---|---|
| 2,938,510 | 5/1960 | Froggatt et al. | 123/364 |
| 3,759,236 | 9/1973 | Staudt et al. | 123/373 |
| 3,923,026 | 12/1975 | Aoki | 123/372 |
| 4,000,728 | 1/1977 | Kurokawa | 123/373 |
| 4,038,958 | 8/1977 | Susuki | 123/374 |
| 4,095,574 | 6/1978 | Yoshino et al. | 123/372 |
| 4,148,290 | 4/1979 | Knorreck | 123/373 |
| 4,164,924 | 8/1979 | Makino | 123/364 |

FOREIGN PATENT DOCUMENTS

| | | |
|---|---|---|
| 49-132416 | 12/1974 | Japan . |
| 52-25549 | 6/1977 | Japan . |

*Primary Examiner*—Ira S. Lazarus
*Assistant Examiner*—Magdalen Moy
*Attorney, Agent, or Firm*—Frishauf, Holtz, Goodman and Woodward

[57] ABSTRACT

A centrifugal governor for internal combustion engines in which the engine speed at which governing action starts varies as a function of the spring constant of a control spring. At least two control springs are provided in a fashion that their respective spring constants are adjustable independently of each other. The governing action can thus take place in two or more different engine r. p. m. ranges with respective percentages of speed change freely settable at optional values.

4 Claims, 5 Drawing Figures

CENTRIFUGAL GOVERNOR

BACKGROUND OF THE INVENTION

This invention relates to a centrifugal governor for controlling the r.p.m. of an internal combustion engine, and more particularly to an all-speed centrifugal governor of a novel construction which has percentages of speed changes freely settable in two or more different engine r.p.m. ranges.

Conventional centrifugal governors used in diesel engines include a type, such as all-speed type, in which a control spring is provided separately from the centrifugal weights for counteracting the centrifugal force thereof. The control spring has its spring constant adjustable by changing the angle of the line of action with respect to the spring by means of a control lever. The spring constant of the control spring determines the engine r.p.m. at which the governor starts governing action, and the percentage of speed change (hereinafter called merely "speed change").

However, only a single control spring is employed in such conventional type governor. Accordingly, the governing action starting r.p.m. and the speed change are kept in a fixed relationship to each other. That is, the speed change has a particular fixed value with respect to each governing action starting r.p.m. Furthermore, since the centrifugal force of the centrifugal weights becomes larger at an increased rate as the engine r.p.m. increases, the speed change of the governor decreases as the governing action starting r.p.m. increases.

For these reasons, the above-mentioned conventional type governor was found useless, for instance, in a specific case where it is necessary to obtain two different voltage currents which may be required of a driving device for welding generators according to the kind of welding required. In such case, the driving device must be operated under the control of an engine governor providing the same speed change in a higher r.p.m. range and in a lower r.p.m. range.

BRIEF SUMMARY OF THE INVENTION

It is therefore an object of the invention to provide a centrifugal governor for internal combustion engines which can provide speed changes in two or more engine r. p. m. ranges, the speed changes being freely settable at optional values, independently of each other.

According to the invention, there is provided a centrifugal governor for internal combustion engines, in which the engine r.p.m. at which the fuel delivery control rod starts to be displaced in the direction of decreasing fuel quantities by the centrifugal force of the centrifugal weights varies as a function of the spring constant of the control spring, characterized in that at least two control springs are provided in a fashion permitting their respective spring constants to be adjusted independently of each other.

According to an embodiment of the invention, first and second control springs are employed, the first spring being arranged to pull the tension lever so as to cause a free end thereof to urge the shifter against the centrifugal force of the centrifugal weights, while the second spring being arranged to push said free end of the tension lever toward the shifter against said centrifugal force.

In another embodiment of the invention, the control springs include a spring engaging the fuel delivery control rod and adapted to urge the control rod in the direction of increasing fuel quantities.

The above and further objects, features and advantages of the invention will more fully appear from the following detailed description taken in connection with the accompanying drawings.

DETAILED DESCRIPTION

Figure 1:
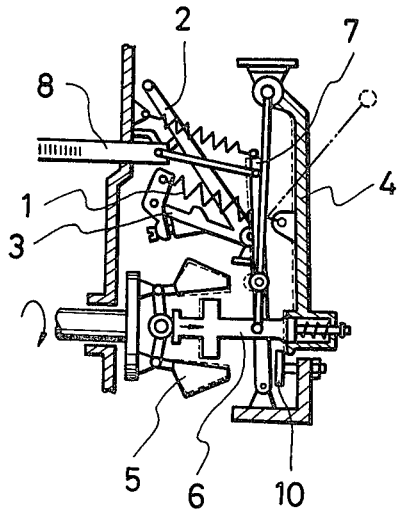
FIG. 1 PRIOR ART
FIG. 1 is a diagrammatic view illustrating a conventional type centrifugal governor.

In FIG. 1 there is shown a conventional type all-speed governor.

A control spring 1, the spring constant of which is adjustable by means of a control lever 2 supported on a fixed fulcrum, is interposed tautly between a swivel lever 3 and a tension lever 4. The spring 1 is adapted to counteract the movement of a shifter 6 caused by the opening motion of centrifugal weights 5 to regulate the movement of a fuel delivery control rod 8 in the direction of decreasing fuel quantities (rightward as viewed in the drawing) which is caused by the movement of the shifter 6 via a floating lever 7. Thus, it is possible to vary the engine r.p.m. at which the governing action starts and the speed change by varying the spring constant of the spring 1.

The speed change $\delta$ for a certain displacement of the fuel delivery control rod 8 is expressed as follows:

$$\delta = \frac{N' - N}{N} \times 100$$

where N is the engine r.p.m. at which the governing action starts, and N' the maximum idling speed, i. e., the maximum speed in off-loaded condition.

The smaller the speed change is, the larger the displacement of the control rod becomes with respect to a certain amount of change in the engine r.p.m. In other words, the governor has a higher sensitivity.

Figure 2:
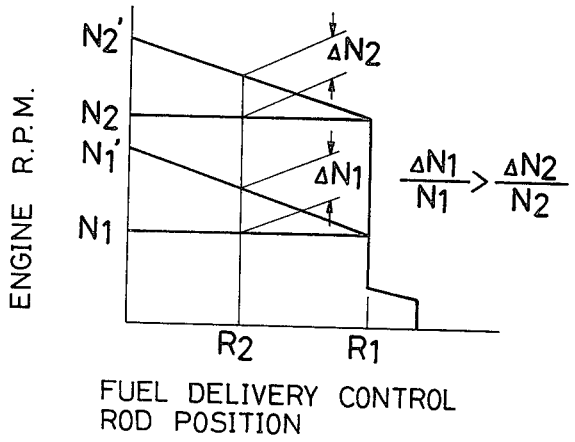
FIG. 2 is a graph showing the operating characteristic of a conventional type governor as illustrated in FIG. 1.

However, in the above-stated conventional type governor, only one control spring is employed, which results in that the governor has a governing action starting r.p.m. and a speed change kept in a fixed relationship to each other. In addition, the higher the governing action starting r.p.m. is, the larger the rate of increase of the centrifugal force produced by the centrifugal weights 5 is. As a consequence, as shown in FIG. 2, when the control rod 8 is displaced from the position $R_1$ at which the governing action starts to the maximum idling speed position $R_2$, the resulting speed change $\delta_2$ in the higher r.p.m. range is smaller than the resulting speed change $\delta_1$ in the lower r.p.m. range, as follows:

$$\delta_1 = \frac{N_1' - N_1}{N_1} \times 100 = \frac{\Delta N_1}{N_1} > \delta_2 = \frac{N_2' - N_2}{N_2} \times 100 = \frac{\Delta N_2}{N_2}$$

That is, as the governing action starting r.p.m. becomes higher, the speed change becomes smaller.

Because of this speed control characteristic, the above-mentioned conventional type governor cannot be employed in a driving device for welding generators or the like which can be required to perform governing action with the same speed change in both a higher and a lower engine r.p.m. range, as previously noted.

Figure 3:
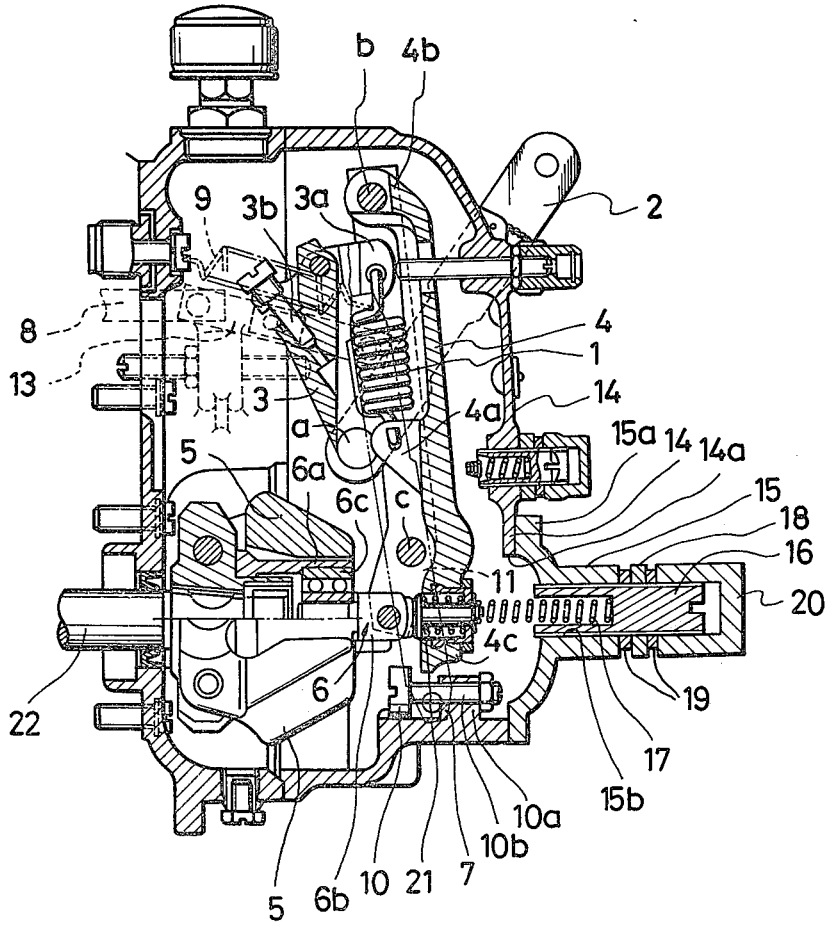
FIG. 3 is a vertical sectional view of a centrifugal governor embodying the present invention.

FIG. 3 illustrates an embodiment of the present invention. A first control spring 1 which is provided as a main spring, is interposed between an end portion 3*a* of a swivel lever 3 and an engaging lug 4*a* of a tension lever 4. The swivel lever 3 is coupled via a common fixed fulcrum a with a control lever 2 which in turn is connected with a handle (not shown) or the like. Said tension lever 4 has an upper end 4*b* pivotally secured to a fixed fulcrum b and a lower end portion 4*c* disposed for urging contact with an end of a shifter 6 via an adaptation spring 21. The shifter 6 comprises a guide bush 6*a* disposed in contact with rollers (not shown) mounted on centrifugal weights 5 secured on a cam shaft 22 of an engine (not shown), and a shifter element 6*b* engaging said guide bush via a radial bearing 6*c*.

The tension lever 4 has its lower end engageable by a full-load stopper 10 for prohibiting the movement of the tension lever 4 toward the centrifugal weights 5 beyond a prescribed range to determine the full-load fuel delivery. A guide lever 11, indicated in dotted line, is linked between the upper end of the tension lever 4 and the shifter element 6*b*.

A floating lever 7, indicated in dot-dash line, is coupled at a middle portion thereof with said guide lever 11 through a common movable fulcrum c. The floating lever 7 is pivotally secured at its lower end to a fixed support 10*a* for the full-load stopper 10 and is connected at a portion near its upper end to a fuel delivery control rod 8 via a link 13. As well known, the control rod 8 is in engagement with a plunger of a fuel injection pump (not shown) and is adapted to be linearly moved to rotate the plunger for varying the injection quantity. The floating lever 7 is further coupled with an end of an engine starting spring 9 which has its other end fixed to the housing 14. An opening 14*a* is formed in a portion of the housing 14 facing the lower end of the tension lever 4. A supporting sleeve 15 is secured to an outer wall of the housing 14 through bolts or the like (not shown) in a fashion that its dish-like head portion 15*a* encloses said opening 14*a*. Said supporting sleeve 15 has a tapped through bore 15*b* formed therein into which a bolt-like element 16 is threadedly fitted. The bolt-like element 16 has an end face having a recess therein into which an end portion of a second control spring 17 is inserted. The second control spring 17 is provided as an auxiliary spring. Said second control spring 17 has its other end disposed in urging contact with a face of the tension lever facing in the direction opposite to the shifter 6 so that it pushes the tension lever 4 in the direction opposite to the direction of movement of the shifter 6 caused by the opening motion of the centrifugal weights 5. The bolt-like element 16 has its other end protruded outwardly of the rear end of the supporting sleeve 15, on which end are threadedly fitted a nut 18 for compensating the length of the sleeve 15, shims 19 and a sealing cap 20.

To adjust the two control springs 1, 17 arranged as above, first the control lever 2 is manually pivoted so as to bring the first control spring 1 into a tensionless or slackened state. Then, the full-load stopper 10 is displaced by rotating its threaded portion 10*b* so that the control rod 8 comes into the maximum fuel delivery position. Next, the bolt-like element 16 is rotated so as to set the spring constant of the second control spring 17 at a value satisfying a desired speed change in a lower r.p.m. range. The control lever 2 is thence pivoted to set the spring constant of the first control spring 1 so as to satisfy a desired speed change in a higher r.p.m. range.

The swivel lever 3 may include a separate end portion element 3*a* for holding the end of the first control spring 1, as illustrated, which is mounted on the body of the lever 3 through a bolt-like element 3*b* which is adjustable in length. Thus, the spring constant of the spring 1 can also be varied to obtain a desired speed change by rotating the bolt-like element 3*b* to change the angle of the first control spring 1 relative to the control lever 2 (but not change the tension force of the spring 1) to thereby change the apparent spring constant of the spring 1. In this manner, the combination of the first control spring 1 and the second control spring 17, both of which have their spring constants thus adjustable to any desired values, enables to obtain any desired speed change in a higher engine r.p.m. range.

In the governor constructed and adjusted as above, governing or speed control action is performed by the second control spring 17 alone in a lower engine r.p.m. range, while in a higher engine r.p.m. range, it is performed by the combined control force of the first and second control springs 1, 17 which cooperate with each other so as to satisfy a desired speed change. More specifically, in a lower engine r.p.m. range, the second control spring 17 is contracted due to the centrifugal force of the flyweights 5 to cause the tension lever 4 to be displaced rightward in FIG. 3, which in turn causes corresponding rightward displacement of the floating lever 7 through the guide lever 11 so that the fuel control rod 8 is moved in the rightward or fuel quantity decreasing direction. In a higher engine r.p.m. range, the first control spring 1 as well as the second control spring 17 is contracted due to the increased centrifugal force of the flyweights 5 to cause the fuel control rod 8 to be displaced in the fuel quantity decreasing direction, in the same manner as mentioned above.

Figure 4:
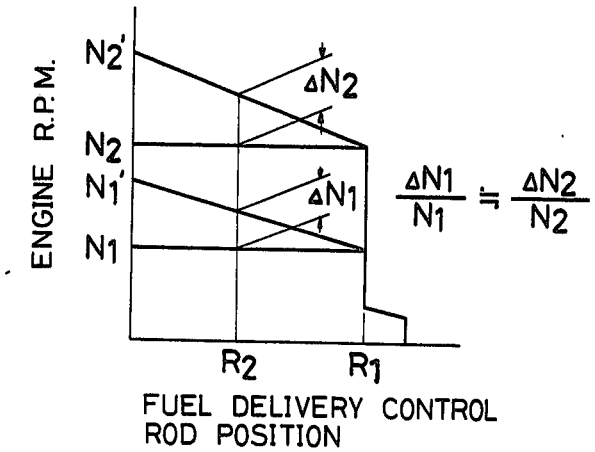
FIG. 4 is a graph showing the operating characteristic of a centrifugal governor according to the present invention.

As a consequence, a governing characteristic as shown in FIG. 4 can be obtained in which the speed change $\Delta N_1/N_1$ in the lower r.p.m. range and that $\Delta N_2/N_2$ in the higher r.p.m. range are substantially the same. Thus, substantially the same speed change can be obtained in any engine r.p.m. range in which the governor carries out its governing action.

Figure 5:
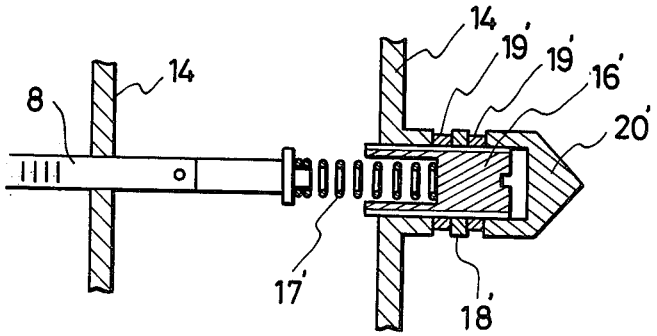
FIG. 5 is a fragmentary sectional view of a centrifugal governor according to another embodiment of the present invention.

FIG. 5 illustrates another embodiment of the invention. A second control spring 17' is mounted directly on an end of the fuel delivery control rod 8 on the side of the floating lever 7 for urging the control rod 8 in the direction of increasing fuel quantities. In FIG. 5, elements corresponding to those in FIG. 3 are given like reference numerals each suffixed with a prime. Also in this embodiment, a similar spring adjustment to that employed in the previous embodiment can apply, and the governing action is carried out in a like manner.

According to the construction of the present invention in which two or more control springs are provided in a fashion permitting adjustment of their respective spring constants, it is feasible to set speed changes in different engine r. p. m. ranges at optional values, respectively. Accordingly, governing or speed control of the engine can be carried out with the same speed change or different speed changes in a lower engine r.p.m. range and a higher engine r.p.m. range. For instance, when the invention is applied to a driving device for generators, the operation of generating two different electrical voltages or currents can be performed with ease and accuracy. In addition to the welding art, the invention has a very wide application.

While I have shown and described certain preferred embodiments of the invention, it is to be distinctly understood that the invention is not limited thereto but may be otherwise variously embodied within the scope of the following claims.

What is claimed is:

1. In an all-speed type centrifugal governor for internal combustion engines, which comprises:

centrifugal weights displaceable as a function of the r.p.m. of an engine; a shifter displaceable in response to the displacement of said centrifugal weights; lever means operatively connecting said shifter with a fuel delivery control rod of a fuel injection pump and including a control lever manually operable from the outside of the governor; and control spring means provided separately from said centrifugal weights and operable to counteract the centrifugal force of said centrifugal weights, the spring constant thereof being adjustable; whereby the r.p.m. of the engine at which said fuel delivery control rod starts to be moved in the direction of decreasing fuel quantities by the centrifugal force of the centrifugal weights through said control spring means and said lever means to effect a governing action varies as a function of the spring constant of said control spring means;

the improvement comprising:

a first control spring provided as a main spring;

a second control spring provided as an auxiliary spring, said second control spring having one end held stationary;

said first control spring and said second control spring forming said control spring means; and means for adjusting the spring constants of said first and second control springs, said adjusting means including said control lever engaging said first control spring for adjusting the spring constant thereof, said adjusting means being arranged to adjust the spring constants of said first and second control springs independently of each other so that the spring constants of said first and second control springs are such that in a lower engine r.p.m. range, said second control spring is deformed due to the centrifugal force of said centrifugal weights to effect a governing action, and in a higher engine r.p.m. range, said first control spring and said second control spring are both deformed due to said centrifugal force to effect a governing action, whereby the governor has speed changes settable at optional values in at least two different engine r.p.m. ranges through said independent adjustments of the spring constants of said first and second control springs.

2. In a centrifugal governor for internal combustion engines, which comprises:

centrifugal weights displaceable as a function of the r.p.m. of an engine; a shifter displaceable in response to the displacement of said centrifugal weights; lever means operatively connecting said shifter with a fuel delivery control rod of a fuel injection pump; and control spring means provided separately from said centrifugal weights and operable to counteract the centrifugal force of said centrifugal weights, the spring constant thereof being adjustable; whereby the r.p.m. of the engine at which said fuel delivery control rod starts to be moved in the direction of decreasing fuel quantities by the centrifugal force of the centrifugal weights through said control spring means and said lever means to effect a governing action varies as a function of the spring constant of said control spring means;

the improvement comprising:

a first control spring provided as a main spring;

a second control spring provided as an auxiliary spring, said second control spring having one end held stationary;

said first control spring and said second control spring forming said control spring means; and means for adjusting the spring constants of said first and second control springs, said adjusting means including said lever means and being arranged to adjust the spring constants of said first and second control springs independently of each other so that the spring constants of said first and second control springs are such that in a lower engine r.p.m. range, said second control spring is deformed due to the centrifugal force of said centrifugal weights to effect a governing action, and in a higher engine r.p.m. range, said first control spring and said second control spring are both deformed due to said centrifugal force to effect a governing action, whereby the governor has speed changes settable at optional values in at least two different engine r.p.m. ranges through said independent adjustment of the spring constants of said first and second control springs;

said lever means comprising a first lever having one end pivotally secured to a fixed fulcrum and the other end disposed for urging contact with said shifter; a second lever having one end pivotally secured to said fixed fulcrum and the other end pivotally connected to said shifter; and a third lever engaging said second lever via a movable common fulcrum and having one end connected with said fuel delivery control rod, wherein said first lever engages both said first control spring which is arranged to pull said first lever so as to cause said other end thereof to urge said shifter against the centrifugal force of said centrifugal weights, and said second control spring which is arranged to push said other end of said first lever toward said shifter against said centrifugal force.

3. In a centrifugal governor for internal combustion engines, which comprises:

centrifugal weights displaceable as a function of the r.p.m. of an engine; a shifter displaceable in response to the displacement of said centrifugal weights; lever means operatively connecting said shifter with a fuel delivery control rod of a fuel injection pump; and control spring means provided separately from said centrifugal weights and operable to counteract the centrifugal force of said centrifugal weights, the spring constant thereof being adjustable; whereby the r.p.m. of the engine at which said fuel delivery control rod starts to be moved in the direction of decreasing fuel quantities by the centrifugal force of the centrifugal weights through said control spring means and said lever means to effect a governing action varies as a function of the spring constant of said control spring means;

the improvement comprising:

a first control spring provided as a main spring;

a second control spring provided as an auxiliary spring, said second control spring having one end held stationary and the other end of said second control spring directly engaging said fuel delivery control rod for urging said fuel delivery control rod in a direction of increasing fuel quantities;

said first control spring and said second control spring forming said control spring means; and means for adjusting the spring constants of said first and second control springs, said adjusting means including said lever means and being arranged to adjust the spring constants of said first and second control springs independently of each other so that the spring constants of said first and second control springs are such that in a lower engine r.p.m. range, said second control spring is deformed due to the centrifugal force of said centrifugal weights to effect a governing action, and in a higher engine r.p.m. range, said first control spring and said second control spring are both deformed due to said centrifugal force to effect a governing action, whereby the governor has speed changes settable at optional values in at least two different engine r.p.m. ranges through said independent adjustments of the spring constants of said first and second control springs.

4. The centrifugal governor of claim 2 or claim 3, wherein said lever means is operable from outside the governor.

* * * * *